US010512291B2

(12) United States Patent
Reuben

(10) Patent No.: US 10,512,291 B2
(45) Date of Patent: Dec. 24, 2019

(54) ARTICLE OF WARMTH WITH INNER REPLACEABLE THERMALLY INSULATING PANELS

(71) Applicant: Ronie Reuben, Town of Mount Royal (CA)

(72) Inventor: Ronie Reuben, Town of Mount Royal (CA)

( * ) Notice: Subject to any disclaimer, the term of this patent is extended or adjusted under 35 U.S.C. 154(b) by 395 days.

(21) Appl. No.: 15/530,362

(22) Filed: Jan. 3, 2017

(65) Prior Publication Data

US 2018/0184737 A1 Jul. 5, 2018

(51) Int. Cl.

*A41D 27/04* (2006.01)
*A47G 9/08* (2006.01)
*A41D 31/06* (2019.01)

(52) U.S. Cl.

CPC ..... *A41D 27/04* (2013.01); *A41D 31/065* (2019.02); *A47G 9/086* (2013.01); *A47G 2200/106* (2013.01)

(58) Field of Classification Search

CPC ..... A41D 27/04; A41D 31/065; A47G 9/086; A47G 2200/106

See application file for complete search history.

(56) References Cited

U.S. PATENT DOCUMENTS 1,513,766 A * 11/1924 Spooner ..... F41H 1/02 109/82
4,261,059 A * 4/1981 Spitz ..... A41D 3/00 2/108
4,390,996 A * 7/1983 Read ..... A41D 15/00 2/70
4,433,019 A * 2/1984 Chumbley ..... A41D 31/02 428/110
4,514,993 A * 5/1985 Johnson ..... F25D 3/08 383/110
4,569,874 A * 2/1986 Kuznetz ..... A41D 31/02 428/109
4,631,765 A * 12/1986 Casey ..... A47G 9/0207 428/33

(Continued)

*Primary Examiner* — Richale L Quinn
(74) *Attorney, Agent, or Firm* — Guy J. Houle; Houle Patent Agency Inc.

(57) ABSTRACT

A thermally insulating article of warmth such as an article of apparel is described and includes removable thermally insulating flexible panels disposed and removably secured between the outer shell fabric and the inner lining fabric. The thermally insulating panels are inserted through an opening having a closure and is retained in position between the outer fabric shell and inner liner by detachable fasteners. The panels are removed to change them with panels having different thermal values or properties to adapt to different climatic conditions or to wash the article without the insulation. By removing the insulation panels the article is less bulky to wash and dry and takes less time for washing and drying while preventing damage to the insulation, particularly if constructed of insulating material which absorbs humidity and has a tendency to form clumps when subjected to impact and stretching forces by the action of a washing and drying machine by being removable. The inner liner may also be detachable and formed as a pouch for the removable securement of the thermally insulating flexible panels.

13 Claims, 4 Drawing Sheets

(56) References Cited

U.S. PATENT DOCUMENTS 4,839,934 A * 6/1989 Rojas ..... A47G 9/0207 5/485
4,864,656 A * 9/1989 Nesse ..... A41D 3/00 2/97
5,393,598 A * 2/1995 Schlecker ..... B32B 27/12 428/102
5,776,567 A * 7/1998 Schilling ..... B01D 29/23 428/34.5
5,867,828 A * 2/1999 Shih ..... A41D 31/02 2/82
6,189,149 B1 * 2/2001 Allen ..... A41D 13/0055 2/102
6,243,896 B1 * 6/2001 Osuna ..... A47G 9/0261 5/502
6,317,893 B1 * 11/2001 Walton ..... A41D 13/012 2/227
6,341,384 B1 * 1/2002 Hayes ..... A41D 27/02 2/458
6,681,399 B1 * 1/2004 Kerr ..... A41D 13/0125 2/2.5
6,996,848 B2 * 2/2006 Donaldson ..... A41D 13/1236 2/16
7,013,496 B2 * 3/2006 Dunn ..... B32B 3/30 2/458
7,018,692 B2 * 3/2006 Kim ..... B32B 3/08 428/51
7,028,342 B1 * 4/2006 Nordstrom ..... A41D 1/04 2/119
7,034,251 B1 * 4/2006 Child ..... H05B 3/342 219/212
7,823,220 B2 * 11/2010 Mazzarolo ..... A41D 15/00 2/108
9,596,896 B2 * 3/2017 Coza ..... B32B 27/12
9,676,168 B2 * 6/2017 Contzen ..... B32B 27/28
9,687,093 B2 * 6/2017 Giles ..... A47G 9/0215
9,687,386 B2 * 6/2017 Carson ..... A61F 7/10
9,950,492 B2 * 4/2018 Banowit ..... B32B 3/20
10,160,184 B2 * 12/2018 Conolly ..... B32B 5/024
2003/0182708 A1 * 10/2003 Gathings, Jr. ..... A41D 3/02 2/97
2005/0102729 A1 * 5/2005 Snedeker ..... A41D 13/0002 2/96
2010/0083417 A1 * 4/2010 Alder ..... B32B 7/05 2/69
2011/0313497 A1 * 12/2011 McFarlane ..... A61F 7/02 607/109
2013/0177731 A1 * 7/2013 Moriarty ..... B32B 27/12 428/74
2016/0198776 A1 * 7/2016 Stevens ..... A41D 13/0051 219/211
2018/0098588 A1 * 4/2018 Pezzimenti ..... A41D 31/065
2018/0169994 A1 * 6/2018 Burwell ..... F16L 59/029
2018/0179678 A1 * 6/2018 Dorton ..... D04H 1/55
2018/0184737 A1 * 7/2018 Reuben ..... A41D 31/065
2018/0216267 A1 * 8/2018 Mason ..... D04H 1/425

* cited by examiner

ARTICLE OF WARMTH WITH INNER REPLACEABLE THERMALLY INSULATING PANELS

TECHNICAL FIELD

The present invention relates to thermally insulating articles of warmth for a user person and more particularly to such articles wherein it includes removable and interchangeable thermally insulating flexible panels detachably retained between an outer fabric and an inner liner fabric or in a detachable liner envelope to modify the thermal insulating value of such articles and to permit the washing of such articles without the thermal insulation therein.

BACKGROUND OF THE INVENTION

Down which is a natural fiber is known to have excellent thermal insulating properties as it is formed of clusters having a plurality of tentacles to which is trapped miniscule air particles. In fact it is considered to be one of the best natural insulation per unit mass and is common in garments for winter outdoor use. Down, in sheet form, as disclosed in my earlier U.S. Pat. No. 6,025,041 provides, in sheet form, constant thermal value of the down throughout its insulating layer while retaining its shape and loft and is lightweight. It is an excellent product for use in the fabrication of articles of apparel.

When down is wet, such as when washing a down filled garment, the down becomes damaged and its insulating efficiency is reduced due to many factors, such as trapping humidity, clumping and trapping cleaning agents such as soap and detergents which are damaging to the down clusters. To overcome these deficiencies synthetic fibers have been used but its disadvantages such as being heavier than down, being bulky and unstable and requiring additional needlework on the article of apparel to stabilize the loose synthetic fibers. Needlework produce cold spots between the outer fabric shell of the garment and its inner liner and adds to fabrication costs.

Thermally insulated articles of apparel, sleeping bags, boots, gloves and other thermally insulating articles to keep a person, or parts of a person warm, are well known in the art. For different climatic conditions, and taking for example a jacket, coat or vest as an article of apparel, it is common for a person to have a different one of such articles to wear to adapt for different climatic periods of the year as the temperature changes from hot to cold and this particularly so in regions which experience four seasons. Also, in certain regions climatic conditions can vary abruptly within a season and it becomes cumbersome, uncomfortable and costly to have to change an article of apparel for short duration of time due to severe temperature fluctuations.

It is also known in the art to fabricate coats and jackets with detachable inner insulating fabric cloths which are attached inside the coat or jacket over the inner liner by the use of button or zipper fasteners to adapt the article to changing weather conditions. These insulating cloths are made of fabric material, such as wool, heavy fabrics, and are placed in direct contact with the wearer person. They are also exposed to outside elements and become soiled and require periodic washing which could cause shrinkage and difficult to install. They also have a low thermal insulation value which provide warmth within a limited temperature range which is not sufficient for use in very cold weather regions where there is snowfall and the temperature drops below freezing. These insulating cloths are also not interchangeable with like cloths having different thermal insulating values. A further disadvantage of such insulating cloths is that if they are secured by zippers and when the zipper breaks, they are no longer attachable until if the zipper repaired. Also, during the repair period the article of apparel is not utilized. This is an inconvenience to the user person and in many cases the insulating cloth is simply discarded.

It is further known in the prior art to provide articles of apparel and duvet covers with pockets in which one can insert hot packs or cold packs to modify the insulating value of the article or to modify its temperature for added comfort. Many of these pouches are bulky and appear as patch work on the article and most packs quickly loose their efficiency and do not provide adequate insulation. Also, they are bulky and distort the fashionable appearance of the garment.

It would be advantageous to be able to quickly convert an article of warmth to make it adaptable to changing weather conditions. This has not been made possible for several reasons in that most articles of warmth, such as articles of apparel are constructed for seasonal use. A winter article of apparel usually contains loose thermal insulation which is stabilized from movement by stitch patterns across the outer fabric shell and the inner liner material to retain the loose insulation permanently captive in stitched pockets to arrest its displacement between the outer shell and inner liner fabrics when the article is in use or being washed. Therefore, most insulated articles of apparel are fabricated for seasonal use and it is therefore necessary to change articles of apparel as the seasons change to adapt it to the changing weather and this is costly to the consumer.

Another disadvantage with articles of warmth such as articles of apparel and sleeping bags which contain loose insulation, is that when these are washed the loose insulation often retains moisture for long periods of time and therefore requiring long drying time in a dryer machine. They also retain detergent which is damaging to the down. Also, the loose insulation has a tendency to form clumps and thereby giving a worn appearance to the article thereby reducing its useful life. Further, the loose insulation in such articles of apparel or sleeping bags gives volume to the article occupying space in a washing or drying machine. It is desirable to overcome this further problem for such articles manufactured with such type of thermal insulation.

A still further disadvantage of articles of warmth is that they cannot adapt to weather changing conditions, such as rain, cold and short lived temperature swings without changing the article of warmth for a different article which is more comfortable to the changed weather. With respect to articles of apparel wherein gel packs or heat releasing packs are inserted in pocket of the article of apparel, a disadvantage of these is that these packets gradually loose their efficiency within a few hours and do not provide their intended result for a long period of time, usually loosing all of their efficiency within four to five hours of use. Also, many of these articles of warmth provide pockets on the outer surface of the outer shell of the article of warmth making it unpleasant to the eye. Still further, the outer shell is often not pleasing to the eyes for all seasonal use.

SUMMARY OF THE INVENTION

It is a feature of the present invention to provide a thermally insulating article of warmth for a person's body which substantially overcomes the above mentioned disadvantage of the mentioned prior art and which provides the mentioned desired needs.

It is a further feature of the present invention to provide an article of warmth for personal use and wherein it comprises one or more inner detachable and interchangeable thermally insulating flexible panels secured between an outer fabric shell and an inner lining fabric or incorporated in a removable inner lining which is formed as an envelope structured for the removable insertion of the panels.

A still further feature of the present invention is to provide thermally insulating flexible panel or panels which are replaceable by a panel or panels having a different thermal insulating factors and other desirable properties to adapt to changing weather conditions.

A further feature of the present invention is to provide an article of warmth for a person's body and wherein the inner thermally insulating material is removably secured from the outer shell and inner liner to permit washing of the article without the thermal insulation to prolong the useful life of the insulation and permit the cleaning of the outer shell and inner liner only which are the parts of the article that become soiled.

Another feature of the present invention is to provide an article of warmth wherein the appearance of the outer shell is not modified to adapt the removable thermally insulating panels which are concealed on the inner side of the outer shell which becomes useful in use during all seasons.

According to the above features, from a broad aspect, the present invention provides a thermally insulating article of warmth having an outer fabric shell and an inner fabric liner interconnected together along seam lines. A free inner defined space is delineated between at least some portions of the outer fabric shell and the inner fabric liner. Access closure means provides access to the free inner space. The free inner space has insulating panel retention means secured at predetermined locations inside the free inner space. One or more thermally insulating flexible panels are configured for occupying a defined location in the free inner space. The thermally insulating flexible panels have a contour shape for close fit in the inner defined space. Each of the thermally insulating flexible panels has attachment means for detachable securement to dedicated ones of the retention means. The thermally insulating flexible panels each has a core formed of down or a down mixture bound together by a binder to form a thermally insulating sheet having opposed parallel surfaces and exhibiting a substantially constant thermal insulating factor between the opposed parallel surfaces while being of light weight. A scrim sheet is secured to at least one of the opposed parallel surfaces. The thermally insulating flexible panels are removable to permit washing of the outer fabric shell and the inner fabric liner without the thermally insulating panels there between whereby to prolong the useful life of the thermally insulating panels while reducing the load and space of the article of warmth in a washing and drying machine.

According to another broad aspect, the present invention provides a thermally insulating article of warmth comprised of an outer fabric shell with an inner removable fabric liner connected thereto. The inner fabric liner is adapted to retain one or more thermally insulating flexible panels configured for occupying a defined location against an inner surface of the outer fabric shell. Each of the thermally insulating flexible panels has a core formed of down or a down mixture bound together by a binder to form a thermally insulating flexible sheet having opposed parallel surfaces. The thermally insulating panels have a substantially constant thermal insulating factor between the opposed parallel surfaces. At least one of the opposed parallel surfaces has a covering secured thereon. Means is provided for removal of the thermally insulating flexible panels to permit washing of the outer fabric shell without the thermally insulating flexible panels to prolong the useful life of the thermally insulating panels and reducing the load and space of the article of warmth in a washing and drying machine.

DESCRIPTION OF THE DRAWINGS

A preferred embodiment of the present invention will now be described with reference to the accompanying drawings illustrating examples of the preferred embodiment and wherein.

DESCRIPTION OF THE PREFERRED EMBODIMENT

Figure 1:
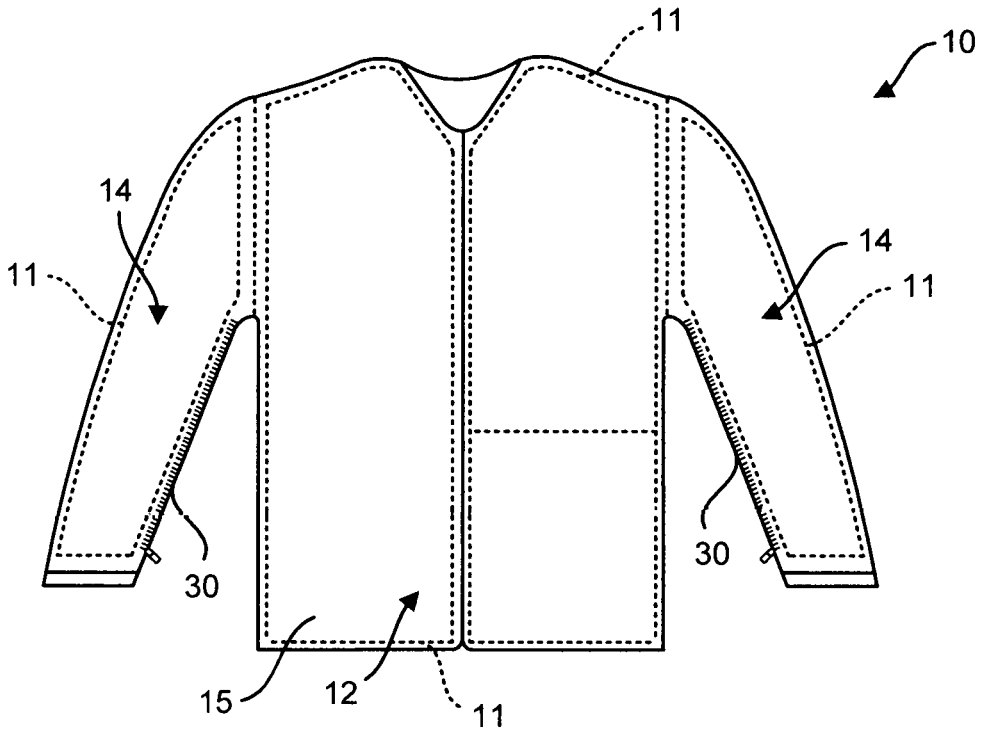
FIG. 1 is a front view of a jacket article of apparel showing in phantom lines the position of thermally insulating panels detachably secured internally thereof and removable for interchange with other different panels or for washing the jacket without the insulating panels.
Figure 2:
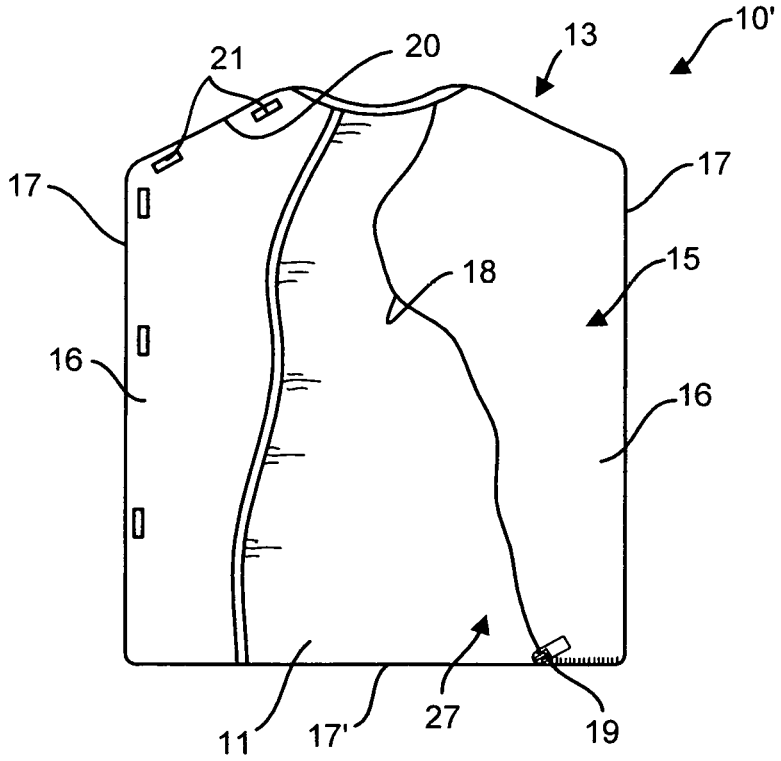
FIG. 2 is a fragmented view of the back portion only of the article of apparel of FIG. 1 showing a large insulating panel with attachments secured inside the space between the outer fabric shell and the inner lining fabric of the back portion of the jacket.
Figure 5:
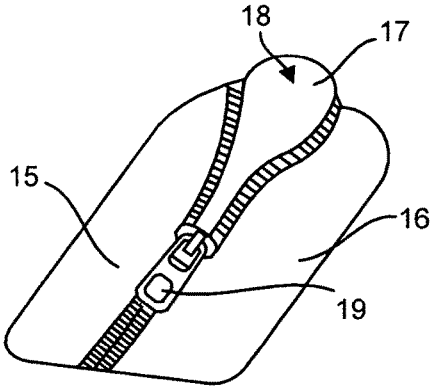
FIG. 5 is a fragmented perspective view showing a zipper fastener interconnecting the outer fabric shell to the inner fabric liner for access to the space.
Figure 8:
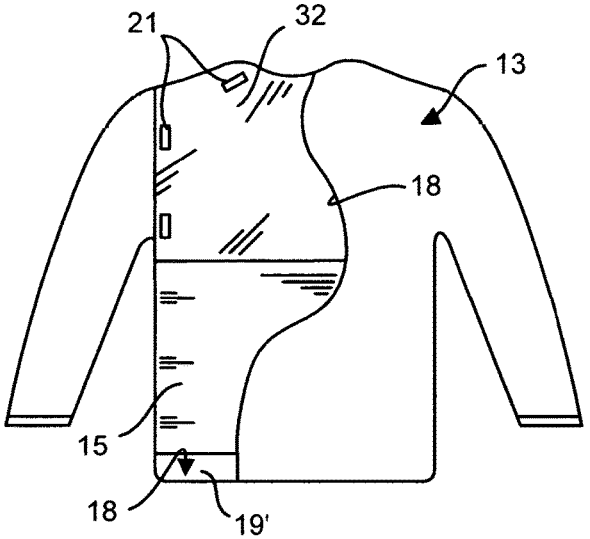
FIG. 8 is a rear view of a jacket article of apparel, partly fragmented, to show a sectional thermally insulating panel secured in the upper back portion only of a jacket.

Referring now to the drawings, and more particularly to FIGS. 1, 2 and 5 there is shown generally at 10 an article of apparel, herein a jacket, in which there is detachably secured thermally insulating flexible panels 11, in the frontal portion 12, rear portion 13 and arm portions 14 of the jacket 10. As better seen from FIG. 2, which is an inside view of the back portion only of the jacket 10, it is formed by an outer fabric shell 15 and an inner fabric liner 16 which are secured together along stitched seams 17. A free space 18 is defined between the outer fabric shell 15 and the inner fabric liner 16. Access closure means, herein in the shape of a zipper type closure 19, is provided adjacent the lower stitched seam 17' to provide access through an opening 27 to inside of the free space 18. FIG. 5 is an enlarged view of the zipper closure 19 which provides access to the space 18. The closure means can also be formed by a back flap 19', as illustrated in FIG. 8, and formed by the inner liner along an edge of the opening leading to the inner space to provide access to the free space 18 while overlapping an edge portion of the thermally insulating panel 11 to retain the panel captive in the inner space and held therein by the opposed outer fabric shell 15 and inner fabric liner 16. Accordingly, in a broad aspect of the invention the thermally insulating panel is retained captive in the inner space by occupying all of the defined location in the free inner space and the retention means is by the opposed outer fabric shell and the inner liner. The thermally insulating panel is thin due to the fact that it is formed of down and very light weight, while being stable to retain its shape within the free inner space.

During fabrication of the article of apparel, herein the jacket 10, there is permanently secured at predetermined locations inside the free space and secured to the outer fabric shell or inner fabric liner and along peripheral edges 20 thereof, detachable retention means herein constituted by magnetically attracting metal or magnetic strips 21. These are glued to the fabric material by suitable glue well known in the art. These magnetic strips 21 can also be secured at different locations depending on the configuration of the thermally insulating panels 11.

Figure 6:
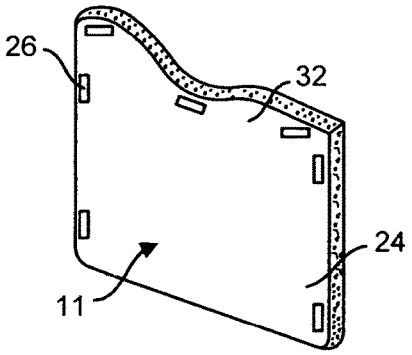
FIG. 6 is a perspective view of the thermally insulating panel being shown in FIG. 8.

With additional reference to FIGS. 6 and 7, the thermally insulating panels 11 are formed by a thermally insulating down core 22, comprised of down mixed with synthetic fibers, feathers, or other mixtures thereof, sandwiched between a pair of scrim sheets 23 and 24 and held captive there between, as described in my aforementioned patent. The surrounding edges 25 of the thermally insulating panel 11 is closed by stitching the scrim sheets together or by fusing the edges 25 of the down sheet, spraying with a binder solution, gluing or other suitable means to hold the insulation 22 captive.

Figure 7A:
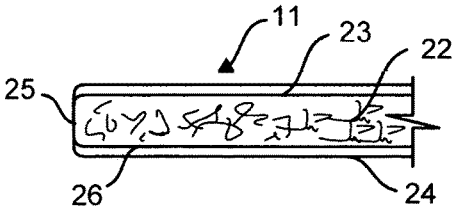
FIGS. 7A and 7B are fragmented cross-sectional views illustrating the construction of two thermally insulating panels having different thermal insulating factors and properties.
Figure 7B:
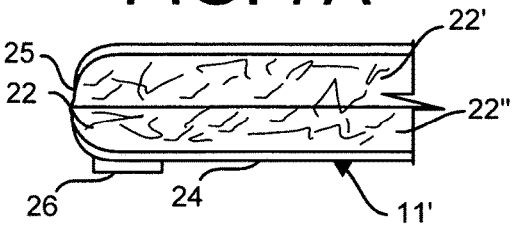

FIGS. 7A and 7B show two different thicknesses of panels which provide different insulating factors. FIG. 7B shows the panel being formed by two sheets 22' and 22"of down having been treated with chemical solutions to provide different properties on opposed sides of the panel 11', as will be described herein below. As illustrated, each panel 11 is of substantially uniform thickness throughout. A preferred form of the panel is one made of down and identified by the trademark "THINDOWN" (trademark) and which identify products as described in my U.S. Pat. Nos. 6,025,041 and 9,380,041. The thermally insulating panels may consist of stretchable down panels which may be used in areas of the article of warmth, such as in the sleeve portions 14 of the jacket 10, where there is expected to be movement or stretch, particularly in the elbow and arm pits of a jacket. The panels may also be formed with a down mixture with synthetic fluffing fibers.

The thermally insulating flexible panels 11 and 11' and the scrim sheets 23 and 24 may also be treated with chemical solutions to provide a variety of properties dependent on its intended use. Also, the scrim sheets may be formed of different non-woven fabrics, polyester, nylon, etc. and they prevent the escape of miniscule down particles or synthetic fiber particles, particularly during washing or manipulation. These scrim sheets are either glued on opposed surfaces of the down core 22 by a suitable glue which is heat activated or pressure activated. The scrim sheets also gives the panels dimensional stability to provide ease of cutting, sewing and handling. The down core 22 can be made with a mixture of down and POLYDOWN (trademark) wherein to enhance the loft of the core, that is to say permit more air into the core to permit the core to bounce back when compressed. The proportions of the mixtures are calculated depending on the intended insulating value or use of the thermally insulating flexible panels 11. Because these panels are made to occupy a large space in the article of warmth they do not require stitching to retain them in position and accordingly this eliminates the formation of cold spots by having to form stitch patterns through the fabrics and insulation to hold the insulation in place. These panels permit the designs and fabrication of down filled articles of apparel with different fashionable appearances which are less puffy and contain no stitch patterns to retain the insulation.

As shown in FIG. 7B, there are two core layers 22' and 22" glued or fused together with at least one of the core layers having been treated with different chemical solutions or each having different mixtures of down or down mixture whereby when in position in an article of warmth, such as a jacket, vest, or coat, provide different properties on opposed sides, one side in contact with the outer shell 15 and the other side in contact with the inner liner 16. The opposed sides, for example, can be treated to provide moisture to escape from the body of the wearer and the opposed side having been treated to provide water proof and/or windproof on its outer side while permitting moisture to escape from within the core. The scrims and/or core can also be impregnated with deodorant odor, fungicide or pesticides or microallergenic solutions or combinations thereof. Of course, the scrim sheets 23 and 24 can the treated likewise or be selected from material offering the same features of waterproof and moisture transmission. The core surfaces can also be sprayed with chemical solutions making it more stable and not requiring scrim sheets. It is also contemplated the treatment of the scrims and/or core with a fire retardant chemical for use in fire fighting articles of apparel or liners. Accordingly, it is also pointed out that these composite insulating panels can convert an outer fabric shell of an article of apparel to adapt to a variety of uses and climatic conditions, such as summer or winter wear, windproof or waterproof or both.

In one preferred embodiment, the panels 11 are provided with attachment means herein in the form of flexible metal strips 26 for magnetic retention by associated ones of magnetically attractive metal strips 21 disposed in the free space 18 between the outer fabric shell 15 and the inner fabric liner 16. The thermally insulating panel 11 shown in FIG. 2 is inserted in the space 18 by opening the zipper closure 19 and turning the outer fabric shell and its inner liner inside out and attaching the thermally insulating panel 11 by positioning matting its metal strips 26 with associated ones of the magnetic strips 21. It is pointed out that the detachable retention means and the attachment means may be provided by other type detachable fasteners, such as VELCRO (loop and hook) strips, buttons and attachment loops, snap fasteners or other suitable attachments. Once the thermally insulating panel 11 is secured in place, the zipper closure 19 closes the access opening 27.

Figure 3:
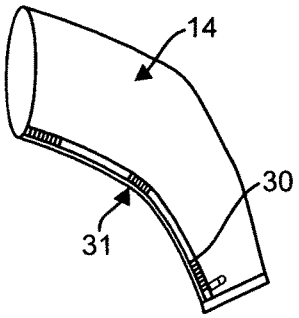
FIG. 3 is a perspective view of a jacket sleeve of an article of apparel showing a zipper type closure for access to the space between the outer fabric shell and the inner fabric liner of the sleeve.
Figure 4:
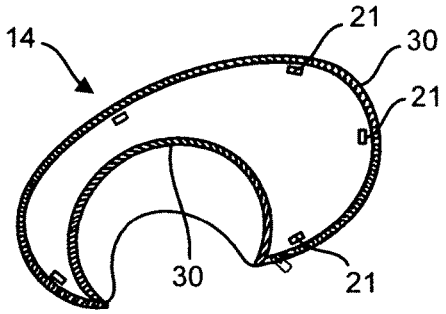
FIG. 4 is a perspective view showing the sleeve of FIG. 3 un-zipped to secure therein a thermally insulating sleeve panel.

FIGS. 3 and 4 illustrate the construction of the arm portion 14 of the jacket 10 of FIG. 1 and it is provided with a zipper closure 30 disposed in the underarm arm 31 of the sleeve 14 which when unzipped, as shown in FIG. 4, exposes the magnetic strips or tabs 21 for attachment of a sleeve panel, not shown.

FIG. 8 is a fragmented view of the rear portion 13 of the jacket 10 and wherein the thermally insulating panel 11 of FIG. 2 has been replaced by a sectional thermally insulating panel 32, as illustrated in FIG. 6, attached to the magnetic strips 21 but extending only in the upper section of the rear part of the jacket to provide warmth to the upper back area of a user person. The sectional thermally insulating panel 32 may also be thinner than the previous panel 11 to provide less thermal insulation. Typically, for cold temperature of about 0 degrees Fahrenheit the thin down panel 11 of the type above referred to would have a weight of about 60 gram/sq. meters and for weather temperatures of −20 degrees Fahrenheit would double that to about 120 grams/sq. meters. These panels of different densities would be available to a user person as a separate panel and changed with the seasons or adapted for a location or country where a user person is planning to travel to. Accordingly, it can be seen, that a single jacket outer shell of the type described replaces the use of two or three different jackets to adapt to changing climatic conditions of the seasons or for use when travelling to different locations where the temperature is cooler or warmer. Because only one jacket is adaptable to different climatic conditions, it is only necessary to travel with one outer jacket fabric shell and a few thermally insulating flexible panels of different thermal insulating value and/or properties and thereby reducing luggage space.

With further reference to FIG. 8, it is noted that when the thermally insulating panel 32 does not fully occupy the free inner space 18, attachment means such as the magnetic strips 21 are necessary. If the panel was to occupy the entire inner space 18, then the overlap flap 19' in the inner liner would suffice in combination with the outer fabric shell and inner liner providing a means of retention for the thermally insulating panel sandwiched there between. It is further pointed out that thermally insulating panel can be sized to be folded upon itself to double the insulation value in a defined inner portion of the free inner space. This would require two panels to occupy the total space.

Figure 9:
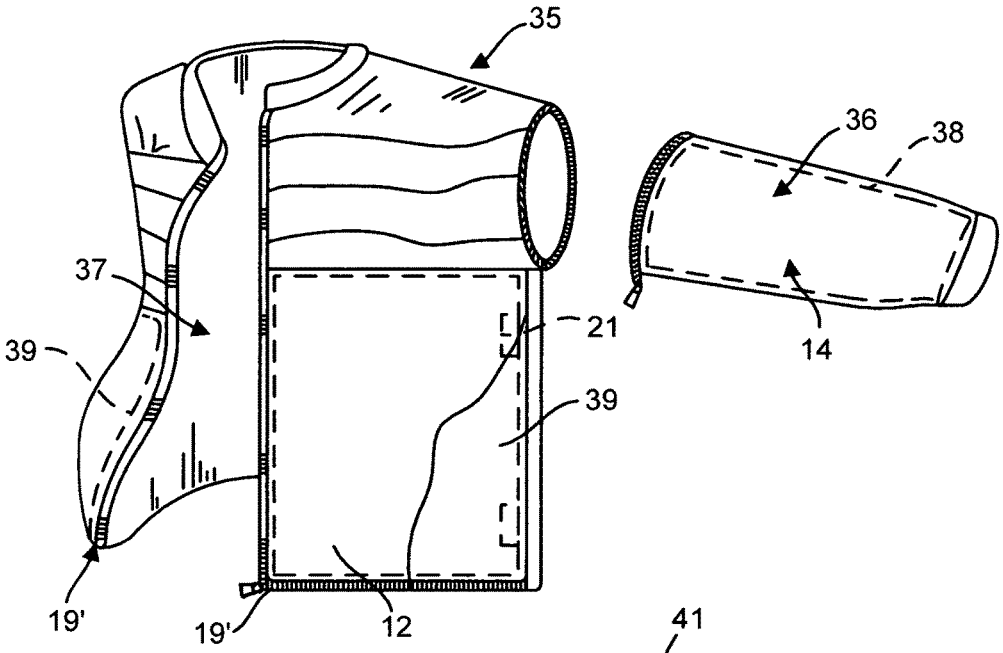
FIG. 9 is a perspective view of a jacket with detachable sleeves to convert it into a vest article of apparel and showing a thermally insulating panel secured at a predetermined inner space between the outer fabric shell and the inner fabric liner of the vest and in the sleeves while other parts of the jacket contains fixed insulation.

FIG. 9 is an exploded and fragmented perspective view of a jacket 35 wherein the sleeves 36 are detachable from the body portion 37 to convert it to a vest article of apparel. The sleeves 36 being detachable facilitates the removal of the inner insulating panel 38 and the insertion of the panel 38. The vest or body portion 37 is herein shown of a design wherein only a portion thereof contains a removable insulating panel 39 accessible through a suitable opening which is closed by a zipper 19' or other type closure means, such as snap closures, VELCRO (loop and hook) closures, button closures, etc.

Figure 10:
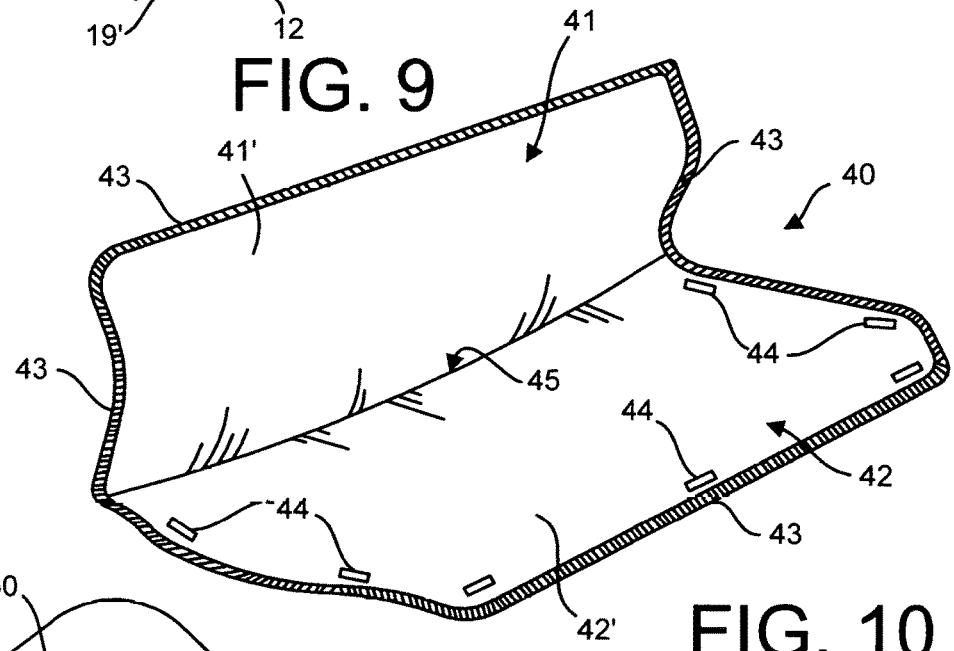
FIG. 10 is a perspective view showing a sleeping bag illustrating the outer fabric shell partly separated from the inner liner by a zipper closure means for access to the free space between the outer fabric shell and the inner fabric liner and the use of magnetic strip fasteners for attaching a thermally insulating panel in the free space.
Figure 11:
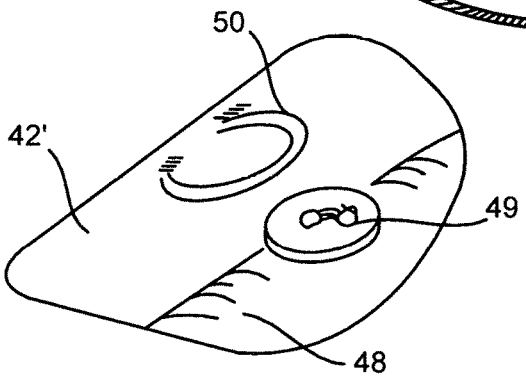
FIG. 11 is a fragmented perspective view showing another type of fasteners, herein button fasteners for attaching a thermally insulating panel in the free space.

With reference now to FIGS. 10 and 11 there is shown another embodiment wherein the article of warmth is constituted by a sleeping bag 40. Instead of loose insulation being disposed between its outer fabric shell 41 and its inner fabric liner 42, and permanently secured by stitch seams or tack stitches, as is common in the art, it can be constructed to receive thermally insulating interchangeable panels of the type above described. As herein shown a side portion of the sleeping bag 40 has a portion 41' of its outer fabric shell 41 detachably secured to an opposed portion 42' of the inner liner 42. These portions 41' and 42' are detachably secured together by closure means such as described above and herein shown as by one or more zippers 43. Detachable retention means in the form of magnetic strips 44 are permanently secured adjacent the outer peripheral edges of the inner surface of the liner fabric, as herein shown. With this embodiment it would be preferable, although not essential, to provide a composite thermally insulating flexible panel 11' as shown in FIG. 7B to provide one of more of the properties mentioned above and in most cases the waterproof and breathability of the panel.

FIG. 11 illustrates another form of the detachable retention means and herein in the form of buttons 49 secured along the outer edge of the thermally insulating panel 48 and disposed at predetermined locations whereby to be engaged with the loops 50 which would replace the magnetic strips 44. Once the portions 41' and 42' are open as shown in FIG. 10, the portions are turned inside out through the access area shown by arrow 45 and a desired thermally insulating panel, not shown, is attached and the zipper(s) 43 are reclosed. The thermally insulating flexible panel can be customized by using a panel as described in FIG. 7B. Accordingly, by changing the thermally insulating panel, the sleeping bag may be adapted to different climatic conditions.

Figure 12:
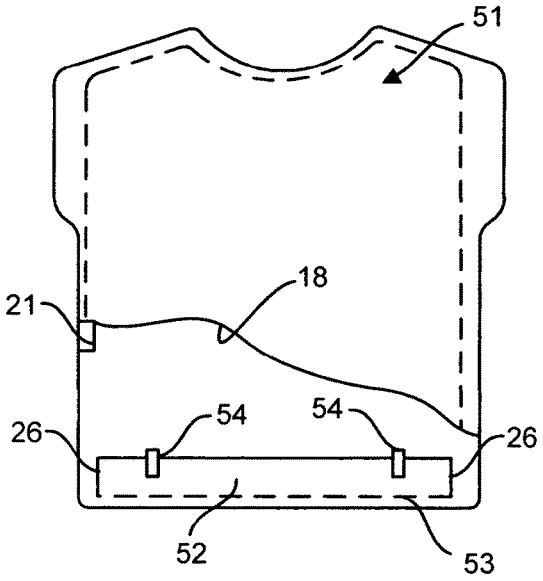
FIG. 12 is a fragmented rear view of a vest article of apparel showing a thermally insulating panel detachably secured in a storage position in roll form along a lower edge of the inner space formed in the back portion of the article of apparel.

Referring now to FIG. 12 there is shown a fragmented view of a vest article of apparel 51 and wherein the thermally insulating panel 52 is permanently secured along an edge 53 adjacent the access opening and held at a storage position in roll form by additional detachable retention means 54, such as previously described. The article could also be a jacket, coat or other type article of warmth where such storage can be accommodated without affecting the outer appearance of the article of apparel. When it is necessary to position the panel 52 at a position of use deployed into the free inner space 18, the retention means 54 is detached and the panel is secured in the space and held therein by further detachable retention means 21 disposed at predetermined position, as previously described.

Figure 13:
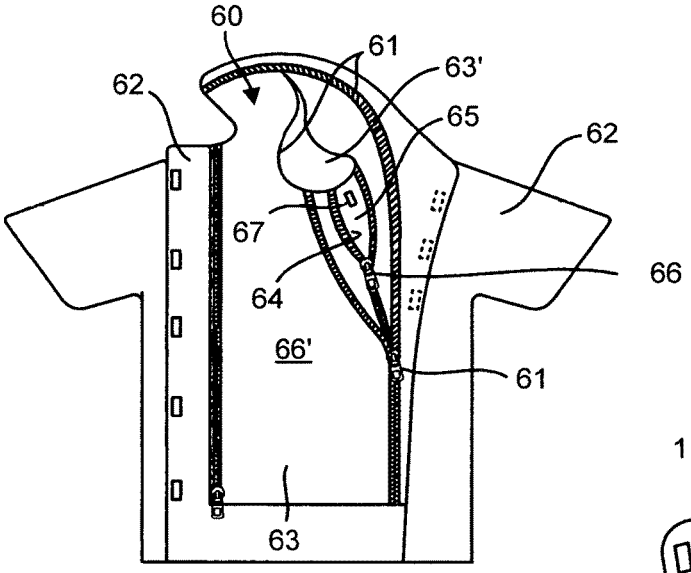
FIG. 13 is a perspective fragmented view illustrating a jacket formed of an outer fabric shell and a detachable inner liner which is formed as an envelope for the removable positioning therein of the thermally insulating flexible panels.

With reference now to FIG. 13 there is illustrated a still further embodiment of the present invention and wherein the inner liner 60 of the article of warmth, herein a jacket or could be a sleeping bag, coat, vest, etc., is formed as an inner fabric shell which is detachable by suitable fastening means, such as the zipper 61 illustrated herein. The detachable inner liner is secured directly to the outer fabric shell 62 and is formed by suitable opposed fabric sheets 63 and 63' interconnected together at peripheral edges to form an envelope 60' defining a free space 64 between the opposed sheets 63 and 63' of the envelope to receive one or more thermally insulating flexible panels 11 or 11' therein through an opening 65 which is accessible via a closure member, herein a zipper closure 66. The advantage of having a removable inner liner is to facilitate the insertion and removal the thermally insulating flexible panels 11 or 11' and to permit the washing of the outer fabric shell, which now has no inner liner, and the inner liner shell without the panels, as is desirable as pointed out above. Attachment members 67 may be secured inside the envelope of the inner fabric shell for receiving complimentary securement members secured to the panels, as described herein above with reference to FIGS. 1-4 and 10.

Figure 14:
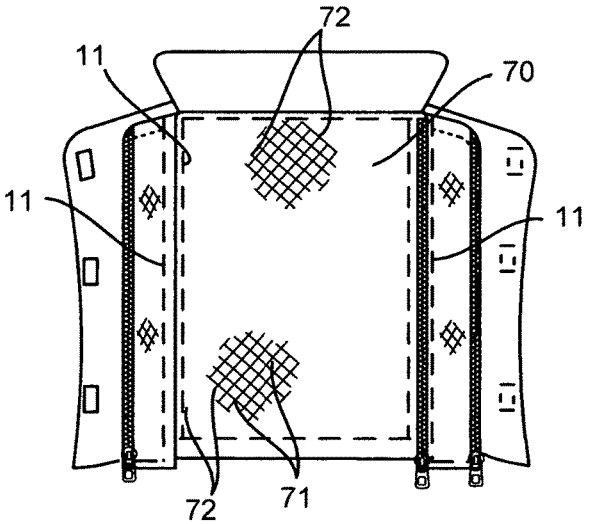
FIG. 14 is another perspective view illustrating a jacket wherein the body portion of which has its liner formed of netting material defining open spaces between the strands of the netting and wherein there is defined an envelope between the outer fabric shell and the netting inner liner with an opening having a closure means to permit the positioning of thermally insulating panels between the outer fabric shell and the netting liner wherein the spaces in the netting provides for the insulating panels to be exposed to the wearer's body.

FIG. 14 illustrates a still further embodiment of the present invention wherein the inner liner 70 is formed of netting material, such material being well known in the art. The netting 70 forms openings 71 between the crossings of the fibers or strands 72 wherein to expose the thermally insulating panel more directly with the wearer's body. In such applications a scrim sheet would not be required on the side of the thermally insulating flexible panel facing the netting material liner. The netting material of the inner liner 70 offers protection to the thermally insulating flexible panels 11 or 11'. Such netting material can also be used as the inner fabric sheet 63 of the detachable liner envelope of FIG. 13.

It is pointed out that many of the different properties of the scrim sheets 66 as described herein may be provided by material currently available in the art. However, such have not been utilized in combination with the core as described herein to provide a thermally insulating material to form insulating panels to convert an article or warmth to adapt to different climatic conditions and to provide, in combination, several additional properties as described herein.

Amongst the many advantage of the articles of warmth of the present invention is that when the articles become soiled and require washing, the thermally insulating panel(s) are removed has they do not require washing having been protected by the outer shell and inner liner which are the parts that are soiled and require cleaning. This creates the advantages that the article being disposed in a washing machine and a drying machine is less bulky and occupies less space. It also dries faster as the insulation panels are removed. The drying time of the insulation is much longer than that of the outer and inner fabrics and washing the insulation can be damaging to the panel as it is subjected to impact and stretching forces in these washing and drying machines. Therefore, by removing the panels the useful life of the thermally insulating articles of warmth is prolonged. Also, if the panels have been treated or constructed to provide additional properties as disclosed herein, it is preferable that the thermally insulating flexible panels not be washed as they are protected when in use and not exposed.

It is within the ambit of the present invention to cover obvious modifications or other articles of warmth where it is desirable to incorporated removable and interchangeable thermally insulating flexible panels as described herein, and for example only, in the construction of boots, pants, mittens, hats, etc. Therefore, all modifications which fall within the scope of the appended claims are intended to be covered.

The invention claimed is:

1. A thermally insulating article of warmth, said article of warmth having permanently secured component parts defined by an outer fabric shell and an inner fabric liner interconnected together along seam lines to define a unitary article of warmth, a free inner defined spaces delineated between at least some portions of said outer fabric shell and said inner fabric liner, closable access openings to provide access to said free inner spaces, said inner spaces each having internal concealed insulating panel retention fasteners secured at predetermined locations inside each said free inner spaces, one or more thermally insulating flexible panels configured for occupying a defined location in each said free inner spaces, said thermally insulating flexible panels having a contour shape for close fit in associated ones of said inner defined spaces, each said thermally insulating flexible panels having attachment fasteners adapted for detachable securement to said internal concealed insulating panel retention fasteners, said thermally insulating flexible panels each defining a core formed of down or a down mixture bound together by a binder to form a thermally insulating sheet having opposed parallel surfaces and exhibiting a substantially constant thermal insulating factor between said opposed parallel surfaces while being of light weight, and a scrim sheet secured to at least one of said opposed parallel surfaces, said thermally insulating flexible panels being removable whereby to permit washing of said outer fabric shell and said inner fabric liner without said thermally insulating panels there between whereby to prolong the useful life of said thermally insulating panels while reducing the load and space of said article of warmth in a washing and drying machine, said thermally insulating flexible panels being interchangeable panels comprising two or more thermally insulating flexible panels each having a different thermal insulation value to convert said article of warmth to one having a different thermal insulating value in said defined location to adapt said article of warmth to many different weather conditions.

2. The thermally insulating article of warmth as claimed in claim 1 wherein said down core is comprised of two core layers formed by two different sheets of down or sheets of down mixture with the core layers bonded together at opposed surfaces which are free of said scrim sheet, one of said two core layers having been treated with a chemical solution or formed with a different down density or mixture from said other of said core layers to provide different properties selected from one or more of the following: moisture transmission, waterproof, windproof, deodorant odor or anti-allergenic or other suitable properties.

3. The thermally insulating article of warmth as claimed in claim 2 wherein said thermally insulating core is sandwich between a pair of said scrim sheets.

4. The thermally insulating article of warmth as claimed in claim 1 wherein said scrim sheet is chemically treated with a water repellant chemical solution, said scrim sheet providing moisture transmission while preventing water to penetrate to said insulating core layer.

5. The thermally insulating article of warmth as claimed in claim 2 wherein said scrim sheet or said core is chemically treated or composed of fibers to have at least one or a combination of the following properties, namely, water repellency, windproof, microallergenic, breathability and fire proofing; said scrim sheet being adhered directly to at least one of said substantially parallel surfaces.

6. The thermally insulating article of warmth as claimed in claim 1 wherein said article of warmth is an article of apparel, said closable access openings having detachable fasteners or an overlap material flap providing access and closure to said inner defined spaces.

7. The thermally insulating article of warmth as claimed in claim 6 wherein said detachable fasteners is one of a zipper fastener, button fasteners, loop and hook fasteners and magnetic fasteners.

8. The thermally insulating article of warmth as claimed in claim 1 wherein said internal concealed insulating panel retention fasteners are permanently secured to at least some of peripheral edges of said free inner defined spaces.

9. The thermally insulating article of warmth as claimed in claim 8 wherein said internal concealed insulating panel retention fasteners are one of VELCRO (loop and hook) fasteners, magnetic strip fasteners and button fasteners.

10. The thermally insulating article of warmth as claimed in claim 1 wherein said article of warmth is constituted by one of a sleeping bag; a coat, a jacket, a pant or a vest article of apparel, said down mixture being comprised of down mixed with high loft polymer fibers to allow said down to recover quickly to enhance the insulating property of down by admitting air therein after being compressed.

11. The thermally insulating article of warmth as claimed in claim 1 wherein said thermally insulating flexible panel is secured at an edge thereof to a lower inner edge of an associated one of said inner defined spaces and stored in roll form along said lower inner edge when not in use to provide insulation in said inner defined spaces.

12. The thermally insulating article of warmth as claimed in claim 1 wherein said thermally insulating panel is of a predetermined size calculated to be folded upon itself to increase its thermal insulating value in at least sections of said free inner defined spaces of said article of apparel.

13. The thermally insulating article of warmth as claimed in claim 5 wherein said scrim sheet is bonded to each said opposed parallel surfaces, said scrim sheet on one of said surfaces facing said outer fabric shell being a waterproof and/or windproof scrim sheet, said scrim sheet facing said inner fabric liner being a breathable scrim sheet.

* * * * *